US005626048A

United States Patent [19]

McClung

[11] Patent Number: 5,626,048

[45] Date of Patent: May 6, 1997

[54] METHOD AND APPARATUS FOR FORMING CUP-SHAPED MEMBERS

[75] Inventor: James A. McClung, North Canton, Ohio

[73] Assignee: Can Industry Products, Inc., Canton, Ohio

[21] Appl. No.: 560,891

[22] Filed: Nov. 20, 1995

[51] Int. Cl.[6] ..... B21D 28/20

[52] U.S. Cl. ..... 72/336; 72/351

[58] Field of Search ..... 72/350, 351, 336, 72/335

[56] References Cited

U.S. PATENT DOCUMENTS

| | | | |
|---|---|---|---|
| 2,243,986 | 6/1941 | Stacy | 72/351 |
| 3,453,848 | 7/1969 | Williamson | 72/351 |
| 4,214,471 | 7/1980 | Bulso, Jr. et al. | 72/349 |
| 4,624,125 | 11/1986 | Bulso, Jr. et al. | 72/453.13 |
| 4,796,454 | 1/1989 | Bulso, Jr. et al. | 72/350 |
| 5,024,077 | 6/1991 | Bulso, Jr. et al. | 72/336 |

FOREIGN PATENT DOCUMENTS

| | | | |
|---|---|---|---|
| 475923 | 3/1992 | European Pat. Off. | 72/351 |
| 4114496 | 11/1992 | Germany | 72/351 |
| 421543 | 3/1974 | U.S.S.R. | 72/350 |

*Primary Examiner*—Daniel C. Crane
*Attorney, Agent, or Firm*—Sand & Sebolt

[57] ABSTRACT

Apparatus and method for forming cup-shaped metal container bodies or end shells from a metal blank in a double-acting press having inner and outer rams which operate in a timed relationship. Preferably, a plurality of blank and draw dies are mounted on a fixed base in opposed relationship to a plurality of draw horns mounted on the inner ram and movable toward the base. A corresponding member of cutting dies and draw pads are mounted on the outer ram and are movable toward the base, whereby the cutting dies cut blank disks from the sheet and the draw pads clamp the disks against the blank and draw dies, followed by the drawing of the container bodies or end shells by the draw horns. A plurality of stacked pressure-actuated pistons is carried by each of the outer rams and moves the draw pad into clamping engagement with the periphery of the blank disk. Spacings are provided between the individual pistons so that the clamping pressure is applied sequentially and cumulatively to the draw pad until the desired total clamping pressure is reached to reduce the impact forces and vibrations on the press, which occurs when the total clamping force is applied instantaneously to the disk blank.

18 Claims, 8 Drawing Sheets

METHOD AND APPARATUS FOR FORMING CUP-SHAPED MEMBERS

BACKGROUND OF THE INVENTION

1. Technical Field

The invention relates to forming cup-shaped members such as container bodies from a blank of metal, and, in particular, to forming such bodies in a double-acting press which reduces the forces exerted on the press by incrementally increasing the pneumatic clamping force exerted on the blank of metal when drawing the container body.

2. Background Information

It is well known in the container-forming art to form two-piece containers, that is, containers in which the walls and bottom of the container are a one-piece member, and the top or end closure is a separate piece, by means of stamping disk-shaped blanks from a strip of metal sheet, and then subsequently drawing the desired configuration into the blank.

In broad terms, the prior art discloses, starting with flat material either in sheet or coil form, blanking material from the sheet stock, and then drawing it into a cup for further redrawing into a final container in the same press or in subsetlent operations. There are a considerable number of prior art patents illustrating various approaches to this formation using either single or double-acting presses. Generally, these prior art presses will simultaneously form a plurality of the container bodies in a single stroke of the single or double-acting press. For example, eight, ten, twelve or more container bodies are formed simultaneously by the single stroke of the press, whether it be a single-action or double-action press.

However, one problem that is encountered with these presses is that they produce excessive noise and forces on the press due to the simultaneous engagement of the initial blank sheet with the plurality of cutting dies or cut edges, followed by the simultaneous pressure holding or clamping engagement of the peripheral edges of the blanks, followed by the simultaneous drawing of all of the cups or container bodies by the movement of a plurality of inner punch or draw members by the inner ram of a double-acting press. These forces present maintenance problems on the dies and press, as well as limiting the number of container bodies or end closure shells which can be produced in a single stroke, or require a larger press having higher tonnages.

The largest forces on the press occur during the pressure-holding or clamping engagement of the peripheral edges of the blanks by the pressure or draw pads. These pressures and forces are considerably larger than those occurring on the press during the blanking of the disks from the sheet metal and the subsequent drawing of the container bodies from the held blanks.

This problem was recognized in U.S. Pat. No. 5,442,947, and in co-pending patent application Ser. No. 08/435,204, which application is assigned to the same assignee as is the present application. This problem appears to be reduced by the method and apparatus of Pat. No. 5,442,947 by providing shims at various locations in the apparatus, so that the clamping pressure is sequentially applied to the peripheries of the blanks to reduce the overall force exerted at the same instant of time on the press during each cycle of the press. This press-loading problem also is reduced by the apparatus and method of the above-identified co-pending application by sequentially blanking all of the disks prior to the sequential clamping of all of the blanked disks against the blank and draw dies, and then followed by the sequential drawing of the container bodies from the clamped disks after the clamping pressure has been sequentially applied to the disks.

However, even though the apparatus and method of the above-described patent and co-pending application helps to reduce the press-loading problem, the apparatus and method of the present invention achieves this result by a completely different operation and modification to existing press constructions.

Thus, it is desirable to produce an apparatus or forming dies and associated method which is capable of producing a single or plurality of container bodies or end shells from steel or aluminum or other stock materials, with a low tonnage press as possible, and with reduced noise and vibrations, while providing the maximum output from the press. However, as indicated above, the forces exerted on the press and dies during the initial blanking, pressure holding and subsequent drawing, limit the output of the press.

Therefore, the need exists for an improved method and apparatus for providing maximum output from a press with as low tonnage rating as possible, while reducing noise and working forces on the press.

SUMMARY OF THE INVENTION

Objectives of the invention include providing an improved apparatus and method for forming cup-shaped members such as end shells or container bodies in a double-acting press from sheet metal material, wherein the material is blanked and drawn into a cylindrical cup-shaped configuration in a single stroke of a double-acting press, with reduced forces and noise exerted on the press than heretofore believed possible with existing presses and dies.

Another objective of the invention is to provide such a method and apparatus which may sequentially blank, hold and then draw the container body, thereby spreading the forces and resulting noise created on and by the press, over a period of time.

Still another objective of the invention is to provide such a method and apparatus in which a plurality of cup-shaped members may be formed sequentially in the press and die, and in which the sequence of forming the members from the sheet blank is staggered in a spaced relationship across the sheet to maintain a balanced pressure thereon.

A further objective of the invention is to provide such a method and apparatus which requires relatively minor adjustments to existing press and die constructions and operation, thereby avoiding costly modifications for retrofitting existing presses.

Another objective of the invention is to provide such a method and apparatus which reduces the forces and resulting noise created on and by the press by incrementally increasing the clamping pressure exerted on the peripheries of the blanks by a stacked array of pistons which surround the draw horn.

These objectives and advantages are obtained by the improved method of the invention for forming a plurality of cup-shaped members, the general nature of which may be stated as including the steps of feeding the metal sheet between a lower blank and draw die and an aligned upper draw horn, pressure-actuated draw pad and cut edge; advancing the cut edge and draw pad toward the metal sheet and the blank and draw die by movement of the outer ram toward the lower blank and draw die; blanking a disk from the metal sheet by advancing the cut edge in a continuous stroke of the outer ram; clamping a periphery of the disk between the draw pad and blank and draw die upon advancement of the draw pad by the continuous stroke of the outer ram by applying a pneumatic clamping pressure on said draw pad; incrementally increasing the pneumatic clamping pressure on the draw pad when clamping the periphery of the disk as the outer ram continues to move toward the lower blank and draw die; advancing the draw horn towards the disk by movement of the inner ram; and drawing the cup-shaped member from the disk, by the advancement of the draw horn in a continuous single stroke of the inner ram.

These objectives and advantages are further obtained by the apparatus of the invention which includes a draw pad carried by the outer ram and a draw horn carried by the inner ram and a blank and draw die carried by the base in opposed relationship to the draw pad and draw horn; a cutting edge carried by the outer ram and surrounding the draw horn for cutting a disk from the metal sheet; and a pressure piston system carried by the outer ram including at least first and second pistons arranged in a stacked relationship about the draw horn, said first piston being operatively engageable with the draw pad to apply a pneumatic clamping force thereto for clamping a periphery of the disk between the draw pad and blank and draw die, with said first and second pistons having a predetermined spacing therebetween for incrementally increasing the pneumatic clamping pressure exerted by the draw pad on the periphery of the disk as the outer ram moves towards the base.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

The method and apparatus of the present invention are utilized in conjunction with a double-acting press having an inner ram 10 and an outer ram 12 movable toward and away from a fixed base 14. The complete press will not be described in detail, since such double-acting presses are well known in the art, and are exemplified generally in U.S. Pat. No. 3,902,348. These presses have the capability of independently controlling the movement of their rams and the tooling associated therewith.

Figure 1:
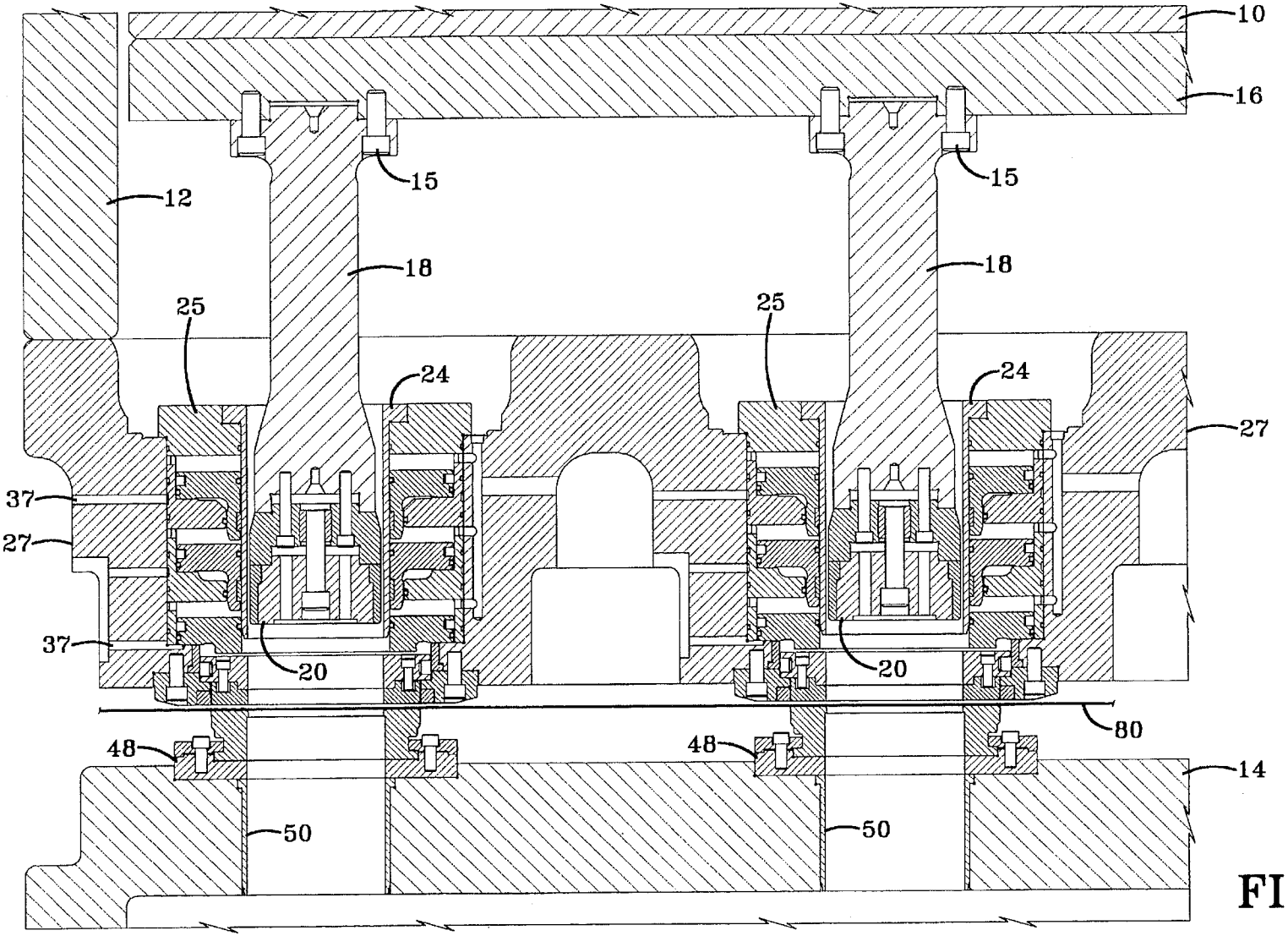
FIG. 1 is a schematic sectional view of a portion of the apparatus of the present invention for forming two cup-shaped members in a double-acting press prior to the start of the forming operation.

Referring to FIG. 1 of the drawings, it is noted that inner ram 10 engages an inner punch holder 16 to which is connected by bolts 15 to a plurality of inner punch risers 18, two of which are shown in FIG. 1. It is understood, and is discussed further below, that a plurality of inner punch risers 18 will be connected to punch holder 16 for simultaneous movement therewith.

FIG. I shows two die assemblies of the present invention operatively connected to inner ram 10 and outer ram 12. In the particular press of the present invention, a plurality of similar assemblies will be spaced in a staggered relationship along the length of the press, only one of which is described in detail and shown particularly in FIGS. 2–7. The various components are exemplary, and are found in most presses and associated dies, and are, therefore, referred to generally, and are well known to anyone skilled in the art.

A draw horn 20 (FIG. 2) is mounted by a horn spacer 21 to inner punch riser 18 by a plurality of bolts 22. Inner punch riser 18 thus will move draw horn 20 in a reciprocal vertical direction upon movement of inner ram 10, as shown by arrow A. A cylindrical guide sleeve 24 surrounds draw horn 20 and is connected to an annular end cap 25. End cap 25 is connected to an annular outer ram housing 27 (FIGS. 1 and 2) by bolts or other attachment means, which housing is moved vertically by outer ram 12.

Figure 8:
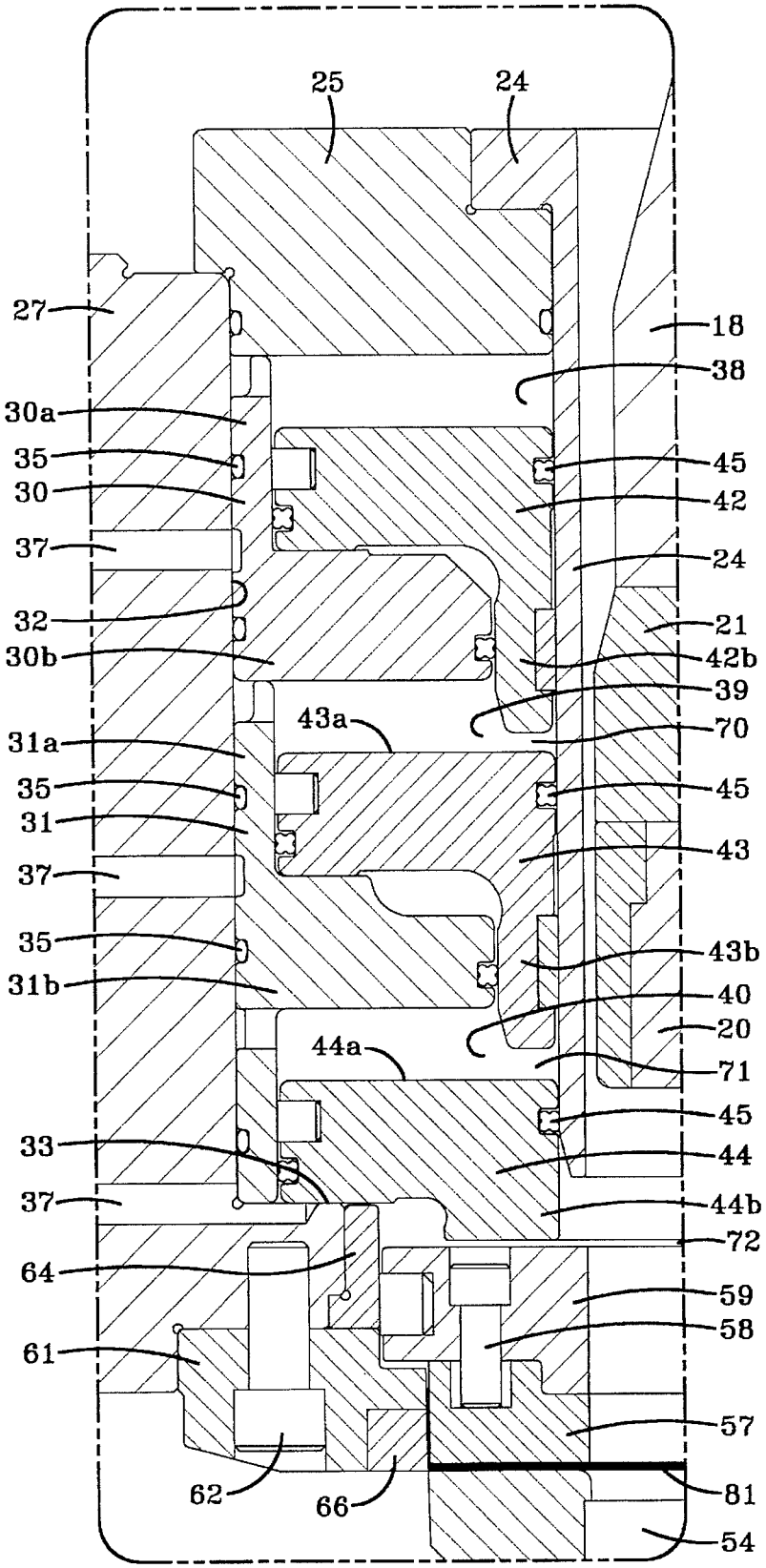
FIG. 8 is an enlarged fragmentary sectional view of a portion of the piston array and draw pad for sequentially applying clamping forces on the blank disks at the start of a cycle, similar to the position shown in FIG. 3.

A pair of annular cylinders (FIGS. 2 and 8), indicated generally at 30 and 31, are mounted in a vertical stacked relationship within an annular bore 32 of outer ram housing 27, and are clamped in position between end cap 25 and an inwardly extending annular shoulder 33 formed at the lower end of ram housing 27. Thus, cylinders 30 and 31 move in unison with outer housing 27 upon actuation of outer ram 12. Each cylinder 30 and 31 has a vertically extending cylindrical side wall **30*a* and 31*a* and an inwardly extending horizontal annular bottom wall 30*b* and 31*b*, respectively. A plurality of O-rings 35 are mounted between the side walls of cylinders 30 and 31 and the cylindrical inner surface of ram housing 27** to provide a fluid seal therebetween.

Cylinders 30 and 31 form a stacked array of annular pressure chambers 38, 39 and 40 within bore 32 of ram housing 27. A plurality of vent passages 37 are formed in outer ram housing 27 and communicate with cylinders 30 and 31 to permit air to escape from and enter into the interior of ram housing 27 during their operation to prevent the formation of a vacuum or air blocking resistance.

Annular pistons 42, 43 and 44 are independently movably mounted within pressure chambers 38, 39 and 40, respectively. Each piston includes an annular horizontal surface portion **42*a*, 43*a* and 44*a* (FIG. 8) on which the pneumatic pressure is applied, and a vertically downwardly extending cylindrical piston leg portion 42*b*, 43*b* and 44*b*, respectively. Vertical leg portions 42*b*, 43*b* and 44*b* are slidably engaged with guide sleeve 24, and have sealing O-rings 45 and annular slide surface blocks 46** mounted therebetween.

A plurality of pressurized air passages 47 are formed in the cylinders and in outer ram housing 27 and communicate with each of the pressure chambers 38, 39 and 40 for supplying a constant supply of pressurized air or fluid into the chambers for moving pistons 42–44 vertically downwardly within their respective cylinders.

An annular draw pad 57 is secured by bolts 58 to an annular mounting ring 59 which is operatively engageable with lowermost piston 44. An annular retainer ring 61 is mounted by bolts 62 to the lower end of outer ram housing 27 and clamps an annular wear sleeve 64 between housing 27 and draw pad mounting ring 59. An annular cut edge 66 is mounted within a recess formed in retainer ring 61, and is also slidably engaged with respect to draw pad 57. These various components discussed above are all standard in the press art, and their features and functions are well known to those skilled in the art, and, thus, their exact constructions and manner of operation are not described in further detail.

Base 14 (FIGS. 2–7), which is indicated as being a fixed base, could be fluidly supported, if desired, in order to reduce the forces exerted thereon and to compensate for thermal expansion, without affecting the concept of the invention. A blank and draw retainer ring 48 is mounted within an annular recess 49 formed in base 14, and secures a cup drop sleeve 50 within a cylindrical opening 53 formed in base 14. An annular draw die clamp 52 secures an annular blank and draw die 54 into an annular recess 51 formed in retainer ring 48 by a plurality of bolts 55. The various components described above with respect to base 14 are well known in the art, and, therefore, their function and exact construction are not described in further detail.

In accordance with one of the features of the invention, the lower end of piston legs **42*b* and 43*b* (FIGS. 2 and 8) are spaced a predetermined distance, indicated at 70 and 71, from the adjacent horizontal surface 43*a* and 44*a* of pistons 43 and 44, respectively, with the lower end of piston leg 44*b* being spaced a distance 72 from the top surface of draw pad mounting ring 59 when outer ram 12 is at the start of its downward stroke and prior to draw pad 57 operatively engaging blank and draw die 54**.

Figure 5:
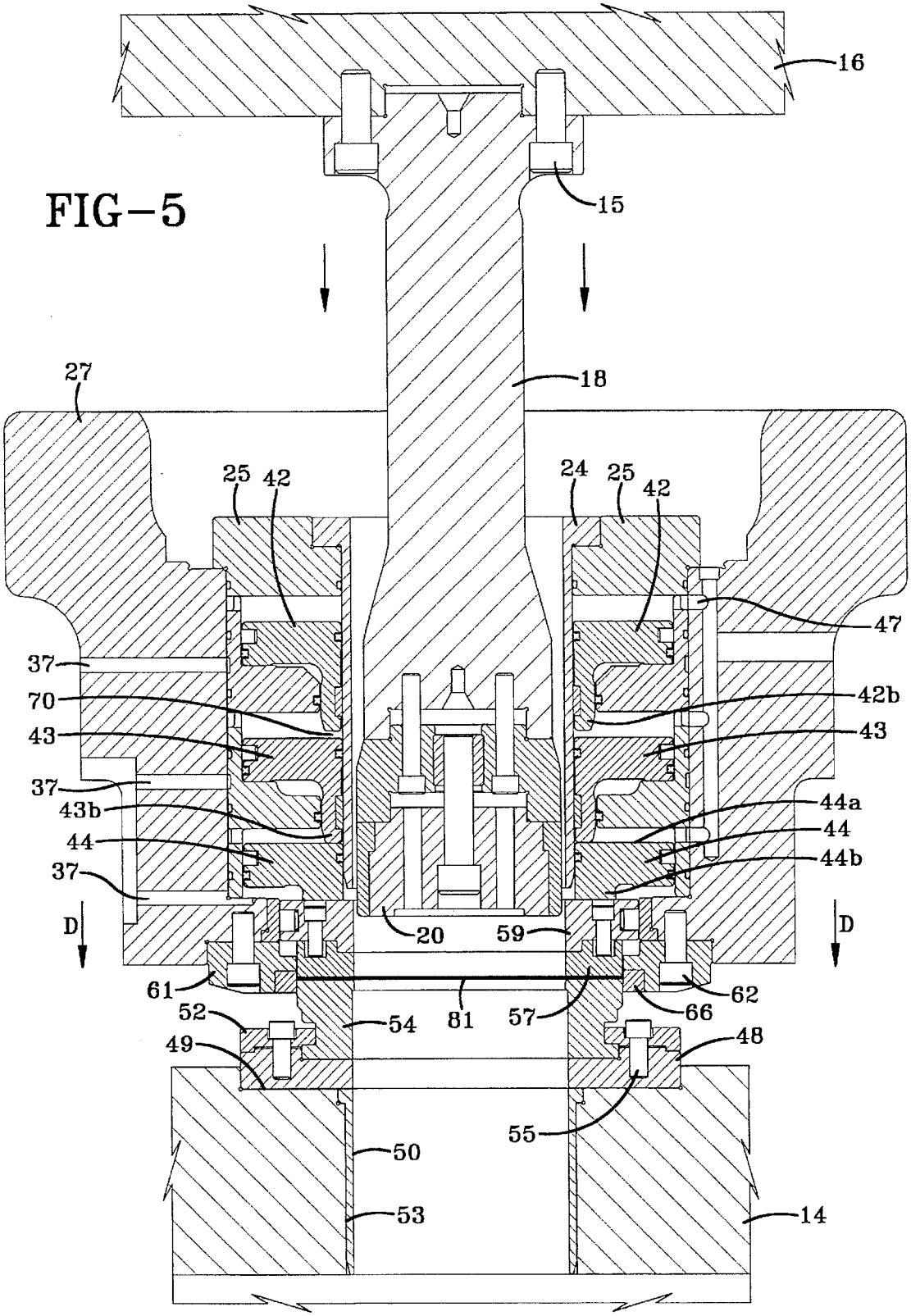
FIG. 5 is a sectional view similar to FIGS. 2–4 showing the second piston engaging the first piston and increasing the clamping pressure by the draw pad on the disk.
Figure 6:
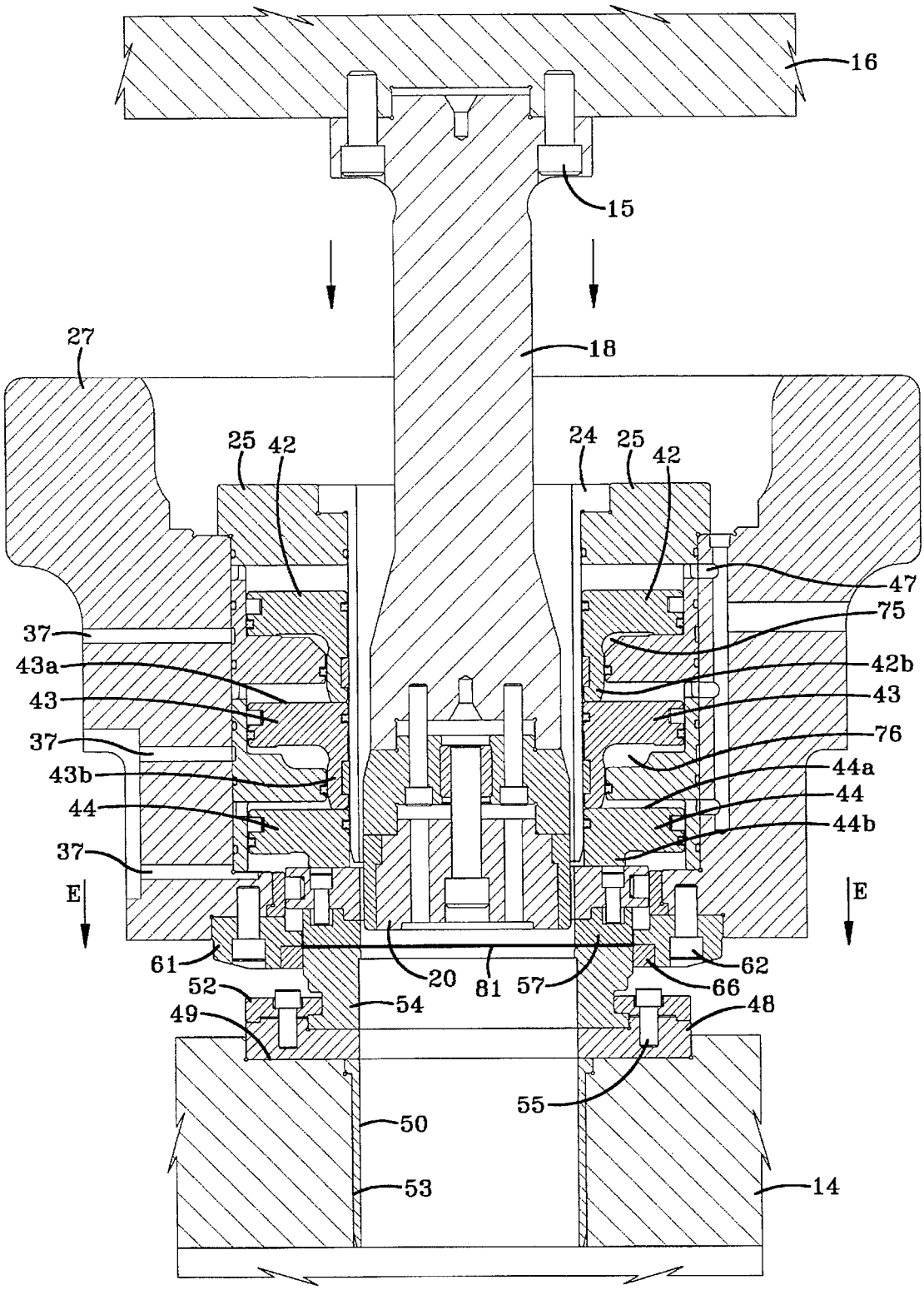
FIG. 6 is a sectional view similar to FIGS. 2–5 showing the third piston engaging the second piston to further increase the clamping pressure.
Figure 7:
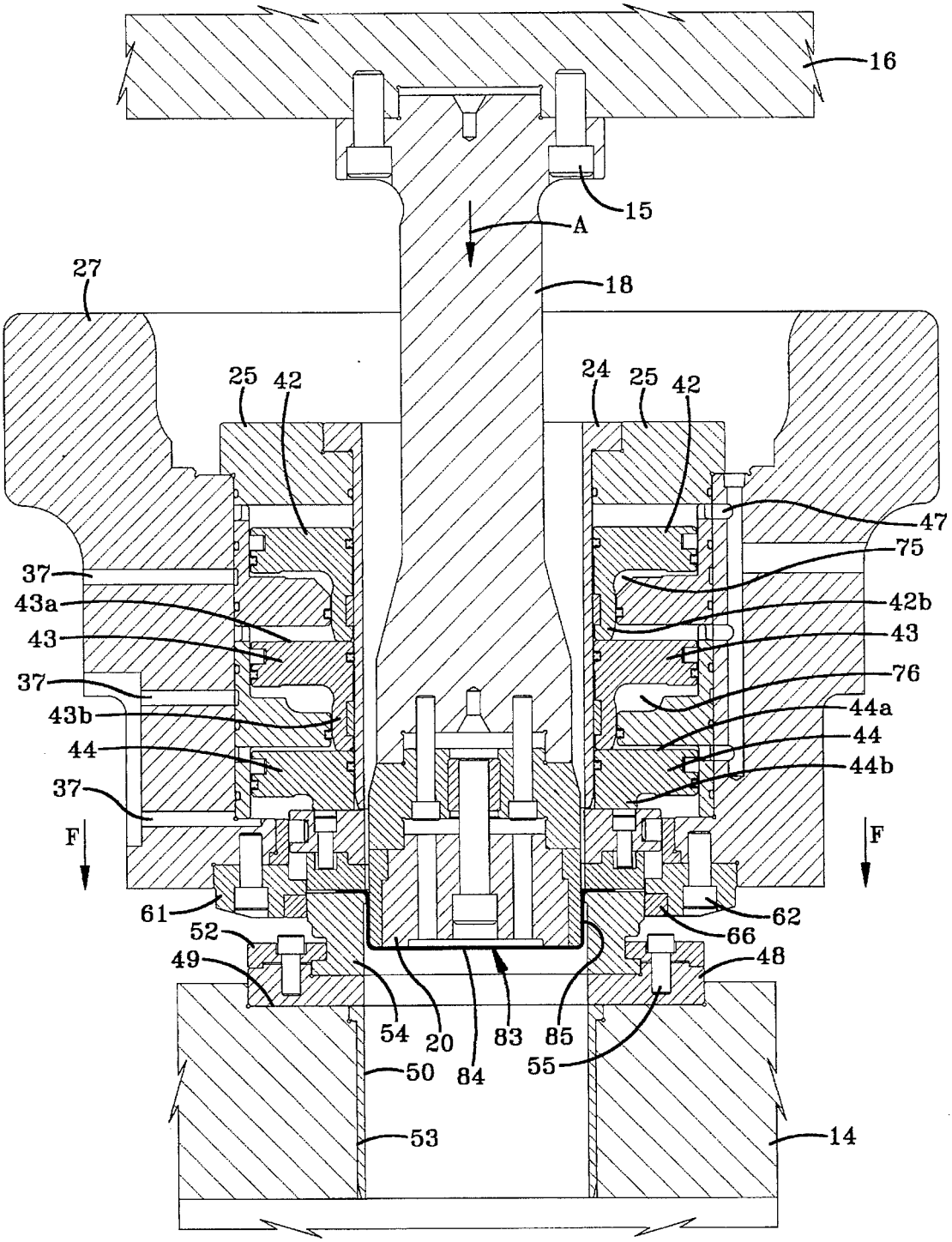
FIG. 7 is a sectional view similar to FIGS. 2–6 showing the draw horn just prior to completely drawing a container body from the disk.

This space ensures that as pistons 42 and 43 move within their respective cylinders, the lower ends of the piston legs will engage the top surface of the lower adjacent piston, as shown particularly in FIGS. 5–7 to sequentially increase the total clamping force applied to draw pad 57.

Figure 2:
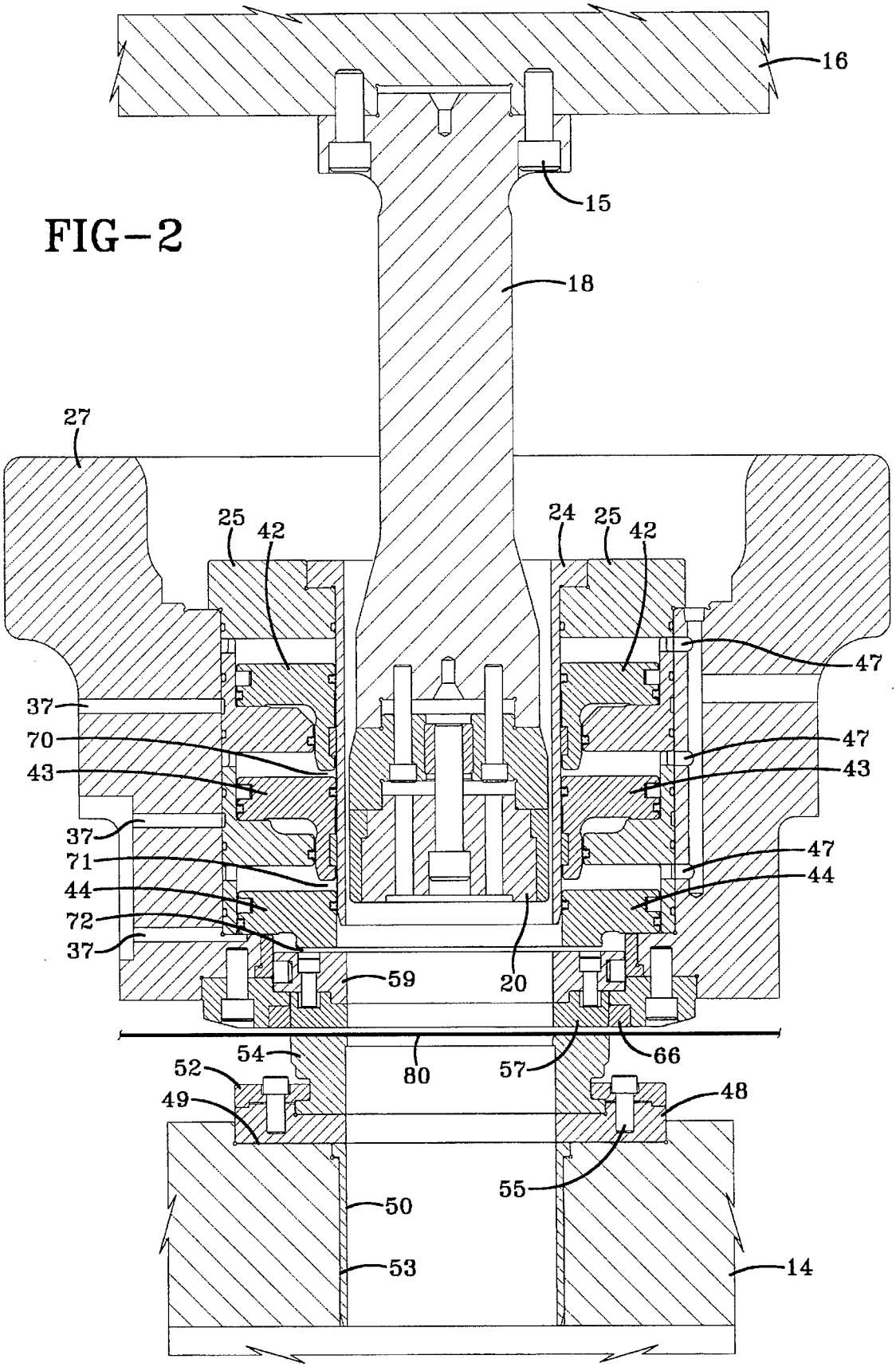
FIG. 2 is an enlarged sectional view of one of the assemblies of the apparatus of FIG. 1 for carrying out the method of the invention after the blanking of the disk from the sheet metal and prior to clamping pressure being applied to the disk by the draw pad.
Figure 3:
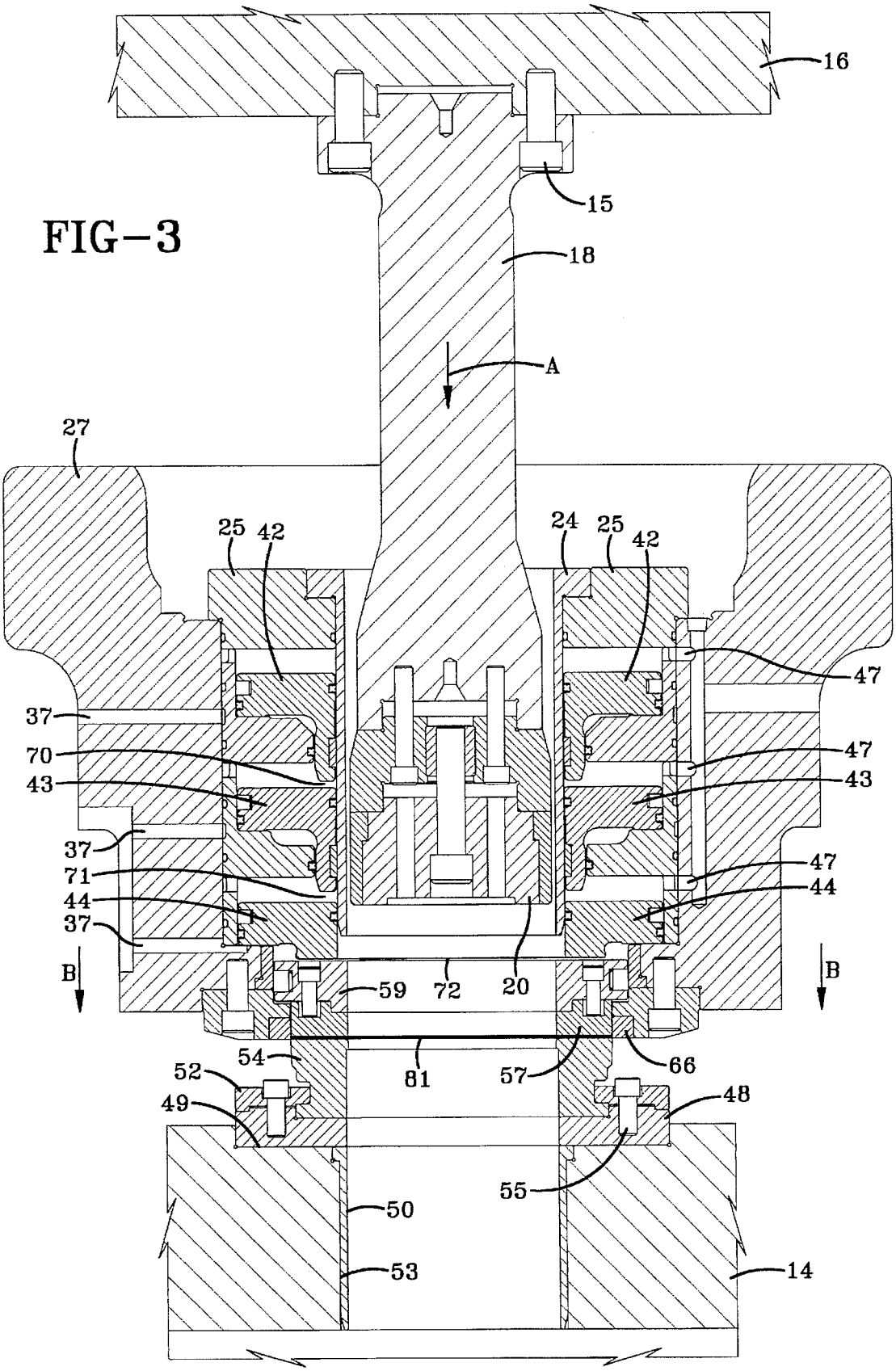
FIG. 3 is a sectional view similar to FIG. 2 showing the position of the assembly after the blanking of the disk from the sheet material and just prior to clamping pressure being applied to the disk by the draw pad and first piston assembly.

FIGS. 1 and 2 show the position of the various components of two of the assemblies with respect to base 14 at the start of a cycle for forming a container body from a continuous strip or sheet 80 of material, such as steel or aluminum. FIG. 3 shows the position of the various components of one of the assemblies after the outer ram has moved downwardly toward base 14, as shown by arrows B, and cut edge 66 has moved along the outer periphery of blank and draw die 54 to form a disk-shaped blank 81 from sheet 80 and just prior to pneumatic clamping pressure being applied to the draw pad. At this stage of the cycle, draw pad 57 has just started to engage blank 81 and lowermost piston 44 has yet to engage draw pad mounting ring 59, with the vertical leg portions of the other pistons remaining in their spaced positions from the lower adjacent piston, as shown in FIG. 3.

Figure 4:
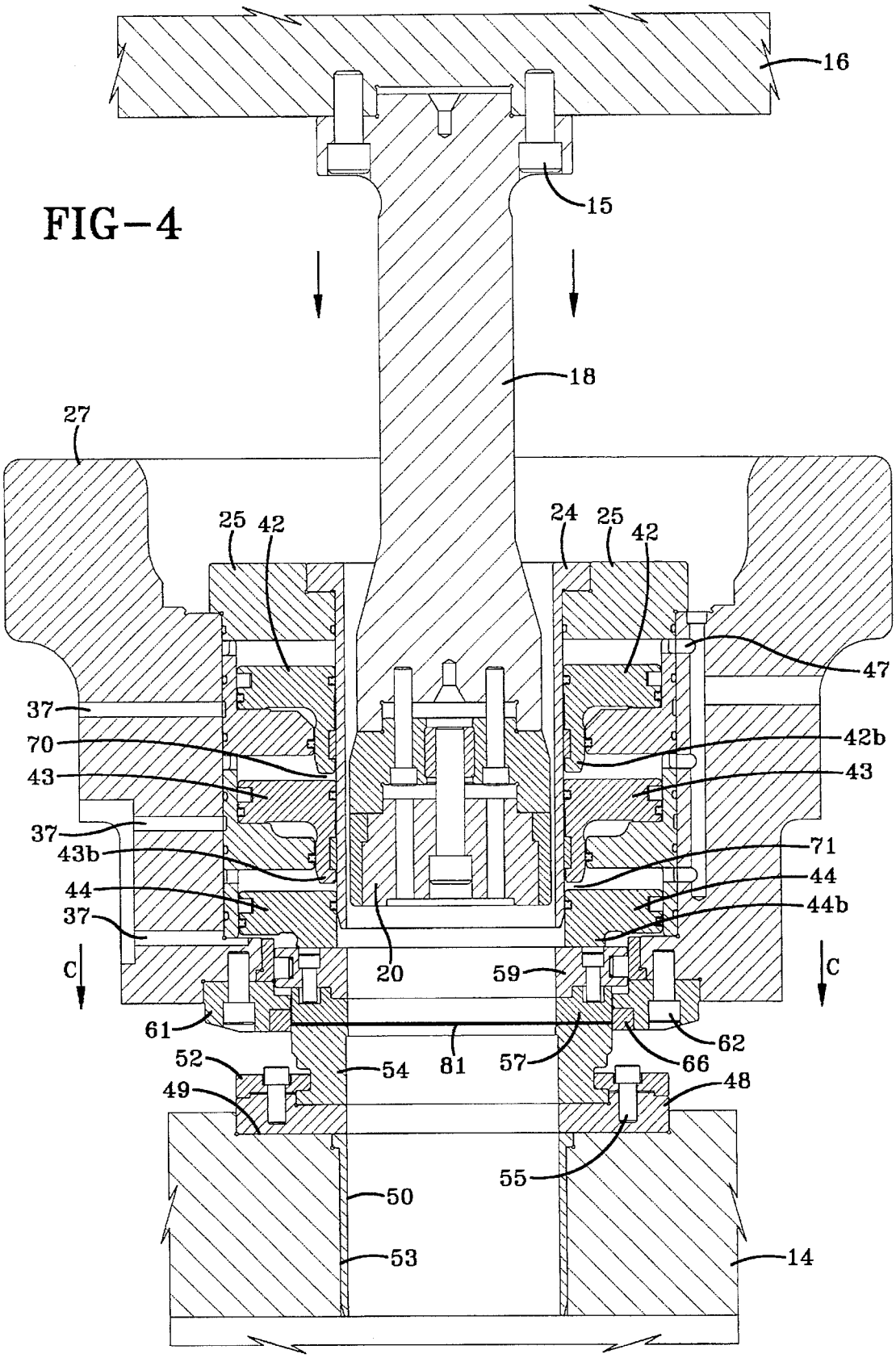
FIG. 4 is a sectional view similar to FIGS. 2 and 3 showing the position of the assembly with the first piston applying clamping pressure to the draw pad and disk.

FIG. 4 shows the position of the various components at the start of the initial clamping of blank 81 by draw pad 57. As ram housing 27 continues to move downwardly by movement of outer ram 12, as shown by arrows C, draw pad 57 will contact the outer periphery of blank 81, lowermost piston 44 which is being moved downwardly with cylinders 30 and 31, and, in particular, vertical leg **44*b* thereof, will engage draw pad mounting ring 59, applying the pneumatic pressure which is exerted on piston 44 to draw pad 57 to clamp the outer periphery of blank 81 against blank and draw die 54. As shown in FIG. 4, the upper two pistons 42 and 43 will maintain their spacings 70 and 71, with respect to the lower adjacent piston. This will result in a predetermined pressure, for example, 100 psi, or a pressure of 2000 lbs., being applied only by piston 44 against draw pad ring 59, and, correspondingly, by draw pad 57, against blank 81**.

Referring to FIG. 5, as outer ram housing 27 continues to move downwardly by the continued movement of outer ram 12, as shown by arrows D, vertical leg portion **43*b* of piston 43 will contact horizontal surface 44*a* of piston 44, causing an additional clamping force to be exerted by draw pad 57 against the blank, since lower piston 44 is prevented from further downward movement due to its engagement with fixed blank and draw die 54. As shown in FIG. 5, spacing 70 is still present between the lower end of piston leg 42*b* and the top horizontal surface of piston 43**.

Referring to FIG. 6, the continued downward movement of outer ram housing 27, indicated by arrows E, will then cause upper piston leg **42*b* to contact horizontal surface 43*a* of intermediate piston 43 by moving through the heretofore spacing 70, causing an additional clamping pressure, for example, another 2000 lbs., to be applied to and by draw pad 57 to the clamped periphery of blank 81. Pistons 44 and 43 are stationary and piston leg 42*b*** moves into contact to apply this additional pressure.

Thus, in accordance with the main feature of the invention as described above and shown sequentially in FIGS. 4, 5 and 6, the three pistons sequentially apply a clamping accumulating pressure to draw pad 57 and against the periphery of formed blank 81. For example, in the preferred embodiment, if the material has a metal thickness of 0.011 inches, spacings 70 and 71 preferably will be in a range of between 0.01 and 0.02 inches, with the preferred spacing being 0.01 inches. The pressure which will be supplied by each piston incrementally will be approximately 2000 lbs., thus providing a total clamping pressure of 6000 lbs., which has been found sufficient to achieve the desired holding and clamping force on the blank periphery when initiating the drawing step, as shown in FIG. 7 and described below.

In prior art presses and the associated tooling and die apparatus therefor, this 6000-pound clamping pressure is applied instantaneously by the downward stroke of ram 12 and housing 27 by the simultaneous engagement of all of the pistons with their lower adjacent piston since there are no spacings, such as represented by 70 and 71, between adjacent pistons, so that the individual pneumatic pressure applied to each of the pistons is applied simultaneously to the draw pad. Although the lapse of time is in milliseconds between the sequential application of the clamping pressures, it is sufficient to considerably reduce the noise and, in particular, the vibrational forces exerted on the tooling and press. This small increment of time between the application of the piston forces is sufficient for much of the force wave vibrations to dissipate from the previous clamping force application.

Thus, the downward movement of outer ram housing 27 will initially cause lower piston 44 to apply a clamping force to the draw pad and, correspondingly, to the periphery of disk 81, followed by the application of an additional clamping pressure by piston 43 engaging piston 44, then followed by the further increased application of clamping pressure due to the engagement of piston 42 with piston 43, which, in turn, is transmitted through piston 44 to draw pad 57.

This incremental application of clamping pressure feature is obtained easily by changing the length of piston legs 42b and 43b, or by other mechanical arrangements which would provide for this separation or spacing of the pistons and the sequential engagement thereof with respect to each other as the outer ram moves downwardly toward base 14.

FIG. 7 shows the position of draw horn 20 and of the piston array after the disk-shaped blank has been partially drawn into a cup-shaped body 83, with the outer ram being in its bottom dead-center position. Each of the container bodies will have a disk-shaped bottom wall 84 and a cylindrical side wall 85. Just prior to the completion of the drawing stage, the upper ram will start its upward ascent, bringing the pistons in a sequential manner with it so as to reduce the holding pressure of draw pad 57 with respect to blank and draw die 54, permitting the peripheral edge of blank 81 to move from between the draw pad and blank and draw die as draw horn 20 continues to move downwardly in the direction of arrow F, preventing wrinkling of the upper portion of the cup. This drawing step and reduction of clamping pressure is well known in the art, and, therefore, is not described in greater detail.

For most applications, a plurality of the particular individual apparatus shown in FIGS. 2–7 will be utilized in most presses to provide for a multiple blank output with each stroke of the outer and inner rams. Also, it is desirable to sequentially blank the material strip, as well as sequentially draw the cup-shaped container body, to further reduce the total pressure and impact forces applied on the press, as described in co-pending patent application Ser. No. 08/435,204, referenced above.

Accordingly the improved apparatus and method of the invention provides for the formation of one, and preferably a plurality of container bodies in a single press stroke by blanking and then sequentially clamping and accumulating the clamping pressure on the disk-shaped blank, and then drawing the clamped blank into a cup-shaped member to reduce the overall pressure and vibrations exerted at any one instant of time on the press and components thereof, as occurs in most prior art presses and die apparatus where the total clamping pressure is applied instantaneously to the blank.

Although the above discussion is directed toward the forming of cup-shaped container bodies, it is readily understood that the same method and apparatus can be used for forming the end shells of the containers which are subsequently attached to the container bodies without affecting the concept of the invention.

Accordingly, the method and apparatus for forming cup-shaped members is simplified, provides an effective, safe, inexpensive, and efficient device and method which achieves all the enumerated objectives, provides for eliminating difficulties encountered with prior devices and methods, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved method and apparatus are constructed, used and carried out, the characteristics of the construction, and the advantageous, new and useful results obtained; the new and useful structures, devices, elements, arrangements, parts, combinations and method steps, are set forth in the appended claims.

I claim:

1. A method of forming a cup-shaped member from a metal sheet in a single continuous stroke of a double-acting press having inner and outer rams, including the steps of:

(A) feeding the metal sheet between a blank and draw die and an aligned draw horn, pressure-actuated draw pad and cut edge;

(B) advancing the cut edge and draw pad toward the metal sheet and the blank and draw die by movement of the outer ram toward the blank and draw die;

(C) blanking a disk from the metal sheet by advancing the cut edge in a continuous stroke of the outer ram;

(D) clamping a periphery of the disk between the draw pad and the blank and draw die upon advancement of the draw pad by the continuous stroke of the outer ram by applying a pneumatic clamping pressure on said draw pad;

(E) incrementally increasing the pneumatic clamping pressure on the draw pad when clamping the periphery of the disk by sequentially advancing a plurality of vertically stacked pistons into engagement with each other and with the draw pad as the outer ram continues to move toward the lower blank and draw die;

(F) advancing the draw horn towards the disk by movement of the inner ram; and (G) drawing the cup-shaped member from the disk, by the advancement of the draw horn in a continuous single stroke of the inner ram.

2. The method as defined in claim 1 wherein the sequential advancing of the pistons is achieved by providing a vertical spacing between adjacent pistons.

3. The method as defined in claim 1 wherein a constant pneumatic pressure is applied to the plurality of stacked spaced pistons for carrying out step (E).

4. The method as defined in claim 1 wherein the pistons are dimensioned and configured so as to engage a lower adjacent piston as the outer ram continues its stroke and the lower adjacent piston is stationary.

5. The method as defined in claim 2 wherein the spacing between adjacent pistons is approximately equal to the thickness of the metal sheet.

6. The method as defined in claim 2 including the step of providing the spacing between said adjacent pistons to be within the range of 0.01 and 0.02 inches.

7. The method as defined in claim 3 wherein the pneumatic pressure applied to each of the pistons is substantially 2000 lbs.

8. The method as defined in claim 7 including the step of providing three vertically stacked pistons whereby the total clamping pressure on the draw pad is substantially 6000 lbs.

9. Apparatus for forming a cup-shaped member from a metal sheet in a double-acting press having inner and outer rams and a base in a single continuous press stroke, including:

a draw pad carried by the outer ram and a draw horn carried by the inner ram and a blank and draw die carried by the base in opposed relationship to the draw pad and draw horn;

a cutting edge carried by the outer ram and surrounding the draw horn for cutting a disk from the metal sheet; and a pressure piston system carried by the outer ram including at least first and second pistons arranged in a stacked relationship about the draw horn and at least two cylinders forming pressure chambers, each of said pistons being independently movably mounted within a respective one of the pressure chambers, said first piston being operatively engageable with the draw pad to apply a pneumatic clamping force thereto for clamping a periphery of the disk between the draw pad and blank and draw die, with said first and second pistons having a predetermined spacing therebetween for incrementally increasing the pneumatic clamping pressure exerted by the draw pad on the periphery of the disk as the outer ram moves towards the base and the second piston engages the first piston.

10. The apparatus defined in claim 9 in which the first piston is operatively engageable with the draw pad; in which the second piston includes a horizontal portion and a vertically downwardly extending leg portion; and in which said leg portion is spaced a predetermined distance from the first piston whereby said leg portion engages the first piston to increase the clamping force exerted by the first piston on the draw pad.

11. The apparatus defined in claim 16 in which the leg portion of the second piston is spaced within the range of between 0.01 and 0.02 inches from said first piston.

12. The apparatus defined in claim 9 in which a third piston is independently movably mounted above the second piston and is engageable with said second piston for further increasing the clamping force applied to the draw pad after the first and second piston have sequentially applied the clamping pressure on the draw pad.

13. The apparatus defined in claim 9 in which the first and second pistons are operatively spaced from each other a distance substantially equal to the thickness of the disk to be clamped between the draw pad and the blank and draw die.

14. The apparatus defined in claim 9 including fluid pressure ports communicating with each of the pressure chambers for applying a constant pressure on the pistons mounted within said chambers.

15. Apparatus for forming a cup-shaped member from a metal sheet in a double-acting press having inner and outer rams and a base in a single continuous press stroke, including:

a draw pad carried by the outer ram and a draw horn carried by the inner ram and a blank and draw die carried by the base in opposed relationship to the draw pad and draw horn;

a cutting edge carried by the outer ram and surrounding the draw horn for cutting a disk form the metal sheet; and a pressure piston system carried by the outer ram including first, second and third pistons arrange in a stacked relationship about the draw horn, said first piston being operatively engageable with the draw pad to apply a pneumatic clamping force thereto for clamping a periphery of the disk between the draw pad and blank and draw die, with said first and second pistons having a predetermined spacing therebetween for incrementally increasing the pneumatic clamping pressure exerted by the draw pad on the periphery of the disk as the outer ram moves towards the base and the second piston engages the first piston, and said third piston being independently movably mounted above the second piston and engageable with said second piston for further increasing the clamping force applied to the draw pad after the first and second piston have sequentially applied the clamping pressure on the draw pad.

16. Apparatus for forming a cup-shaped member from a metal sheet in a double-acting press having inner and outer rams and a base in a single continuous press stroke, including:

a draw pad carried by the outer ram and a draw horn carried by the inner ram and a blank and draw die carried by the base in opposed relationship to the draw pad and draw horn;

a cutting edge carried by the outer ram and surrounding the draw horn for cutting a disk from the metal sheet; and a pressure piston system carried by the outer ram including at least first and second pistons arranged in a stacked relationship about the draw horn, said first piston being operatively engageable with the draw pad to apply a pneumatic clamping force thereto for clamping a periphery of the disk between the draw pad and blank and draw die, with said first and second pistons having a predetermined spacing therebetween for incrementally increasing the pneumatic clamping pressure exerted by the draw pad on the periphery of the disk as the outer ram moves towards the base and the second piston engages the first piston, said first and second pistons being operatively spaced from each other a distance substantially equal to the thickness of the disk to be clamped between the draw pad and the blank and draw die.

17. A method of forming a cup-shaped member from a metal sheet in a single continuous stroke of a double-acting press having inner and outer rams, including the steps of:

feeding the metal sheet between a blank and draw die and an aligned draw horn, pressure-actuated draw pad and cut edge;

advancing the cut edge and draw pad toward the metal sheet and the blank and draw die by movement of the outer ram toward the blank and draw die;

clamping the metal sheet between the draw pad and the blank and draw die upon advancement of the draw pad by the continuous stroke of the outer ram by applying a pneumatic clamping pressure on said draw pad;

incrementally increasing the pneumatic clamping pressure on the draw pad when clamping the metal sheet by sequentially advancing a plurality of vertically stacked pistons into engagement with each other and with the draw pad as the outer ram continues to move toward the lower blank and draw die;

advancing the draw horn towards metal sheet by movement of the inner ram;

blanking a disk from the metal sheet by advancing the cut edge in a continuous stroke of the outer ram; and drawing the cup-shaped member from the disk, by the advancement of the draw horn in a continuous single stroke of the inner ram.

18. Apparatus for forming a cup-shaped member from a metal sheet in a double-acting press having inner and outer rams and a base in a single continuous press stroke, including:

a draw pad carried by the outer ram and a draw horn carried by the inner ram and a blank and draw die carried by the base in opposed relationship to the draw pad and draw horn;

a cutting edge carried by the outer ram and surrounding the draw horn for cutting a disk from the metal sheet; and a pressure piston system carried by the outer ram including at least first and second pistons arranged in a stacked relationship about the draw horn and at least two cylinders forming pressure chambers, each of said pistons being independently movably mounted within a respective one of the pressure chambers, said first piston being operatively engageable with the draw pad to apply a pneumatic clamping force thereto for clamping the metal sheet between the draw pad and blank and draw die, with said first and second pistons having a predetermined spacing therebetween for incrementally increasing the pneumatic clamping pressure exerted by the draw pad on the metal sheet as the outer ram moves towards the base and the second piston engages the first piston.

* * * * *